US008857479B2

(12) United States Patent
Loaec et al.

(10) Patent No.: US 8,857,479 B2
(45) Date of Patent: Oct. 14, 2014

(54) FILLING MACHINE WITH A VARIABLE FILLING RATE

(75) Inventors: Thierry Loaec, Octeville sur Mer (FR); Hervé Saliou, Octeville sur Mer (FR); Mickaël Huitorel, Octeville sur Mer (FR); Arnaud Pasquet, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 421 days.

(21) Appl. No.: 13/319,018

(22) PCT Filed: May 5, 2010

(86) PCT No.: PCT/FR2010/050855
§ 371 (c)(1), (2), (4) Date: Nov. 4, 2011

(87) PCT Pub. No.: WO2010/128247
PCT Pub. Date: Nov. 11, 2010

(65) Prior Publication Data

US 2012/0048423 A1 Mar. 1, 2012

(30) Foreign Application Priority Data

May 5, 2009 (FR) ..... 09 52987

(51) Int. Cl.

| | |
|---|---|
| ***B67C 3/00*** | (2006.01) |
| ***B65B 3/26*** | (2006.01) |
| ***B65B 59/00*** | (2006.01) |
| ***B67C 3/28*** | (2006.01) |
| ***B65B 43/60*** | (2006.01) |
| ***B65B 39/02*** | (2006.01) |

(52) U.S. Cl.
CPC ... *B67C 3/28* (2013.01); *B65B 3/26* (2013.01); *B65B 59/00* (2013.01); *B65B 43/60* (2013.01); *B65B 39/02* (2013.01)
USPC ..... 141/242; 141/144; 141/261; 222/310; 222/505

(58) Field of Classification Search
CPC ..... B67C 3/02; B67C 3/22; B67C 3/28; B67C 3/286; B67C 3/26
USPC ..... 141/57, 144–152, 237, 238, 242–245, 141/261, 264; 222/282, 310, 505–508, 529
See application file for complete search history.

(56) References Cited

U.S. PATENT DOCUMENTS 2,590,215 A 3/1952 Sausa
2,761,605 A * 9/1956 Pahl et al. ..... 141/141

(Continued)

FOREIGN PATENT DOCUMENTS

CN 2493607 Y 5/2002
CN 101354083 A 1/2009

(Continued)

*Primary Examiner* — Timothy L Maust
(74) *Attorney, Agent, or Firm* — Patterson Thuente Pedersen, P.A.

(57) ABSTRACT

A machine for filling containers in which the filling rate for the products can be varied, thus enabling the filling machine to be used for different filling products, and in particular products having different viscosities. The machine comprises at least one filling station comprising a filling spout provided with a supply opening and a discharge opening, a blocking system mounted in the filling spout, and a supply pipe connected to the supply opening upstream of said blocking system. The supply pipe comprises at least one section made of a flexible tube, the supply apparatus further comprising a clamp adapted to clamp the flexible tube in order to modify the cross-section of the internal passage of the flexible tube, the clamp adapted to move between at least two positions corresponding to different cross-sections of the internal passage of the flexible tube.

9 Claims, 4 Drawing Sheets

(56) References Cited

U.S. PATENT DOCUMENTS

| | | | | |
|---|---|---|---|---|
| 4,508,148 | A * | 4/1985 | Trechsel et al. | 141/147 |
| 4,570,822 | A * | 2/1986 | Procacino | 222/14 |
| 4,582,102 | A | 4/1986 | Risser | |
| 4,607,764 | A * | 8/1986 | Christine | 222/207 |
| 5,168,905 | A * | 12/1992 | Phallen | 141/1 |
| 5,524,683 | A * | 6/1996 | Mueller | 141/129 |
| 5,947,167 | A * | 9/1999 | Bogen et al. | 141/1 |
| 6,216,918 | B1 * | 4/2001 | Saveliev et al. | 222/148 |
| 6,352,089 | B1 | 3/2002 | Breton | |
| 7,815,079 | B2 * | 10/2010 | Saveliev et al. | 222/509 |
| 8,261,783 | B2 | 9/2012 | Macquet et al. | |
| 8,291,945 | B2 | 10/2012 | Maubois et al. | |
| 8,387,668 | B2 | 3/2013 | Macquet et al. | |
| 2010/0032056 | A1 | 2/2010 | Lebras | |
| 2010/0300580 | A1 | 12/2010 | Macquet et al. | |

FOREIGN PATENT DOCUMENTS

| | | | |
|---|---|---|---|
| DE | 32 10 738 | A1 | 10/1983 |
| DE | 93 21 066 | U1 | 1/1996 |
| DE | 10 2007 036 265 | A1 | 2/2009 |
| WO | WO 03/048616 | A1 | 6/2003 |
| WO | WO 2004/018345 | A1 | 3/2004 |

* cited by examiner

FILLING MACHINE WITH A VARIABLE FILLING RATE

PRIORITY CLAIM

The present application is a National Phase entry of PCT Application No. PCT/FR2010/050855, filed May 5, 2010, which claims priority from French Application No. 0952987, filed May 5, 2009, the disclosures of which are hereby incorporated by reference herein in their entirety.

TECHNICAL FIELD

This invention relates to a machine for filling containers with a filling product. The invention relates more particularly to a filling machine in which the filling rate for the filling product can be varied thus enabling the filling machine to be used for different filling products, and in particular products having different viscosities.

BACKGROUND ART

Machines for filling containers comprising at least one filling station are known, in particular so-called rotating machines and so-called linear machines comprising a plurality of filling stations, wherein each filling station comprises a filling spout provided with a supply opening and a discharge opening and metering means comprising a blocking system mounted in the filling spout, and able to be controlled between a closed position and at least one open position. Each station further comprises a supply mechanism in order to supply the filling spout with filling product, the supply mechanism comprising a supply pipe, connected to the supply opening of the filling spout upstream of the blocking system. In the case of a rotating or linear machine, the supply pipes conventionally connect the filling spouts to a single on-board tank or a single feed line connected to an offset tank.

According to the viscosity of the product, the presence of pieces or of particles, the cross-sections of product passage of each filling station must be different, in order to control the speed of the flow of the product via adapted losses of head and to obtain a clean metering and without overflow in an allotted timeframe. In order to adapt the machine to different filling products, rigid supply pipes of different diameters are conventionally used. Replacing supply pipes of all of the filling stations is long and tedious.

SUMMARY OF THE INVENTION

The purpose of this invention is to propose a solution aiming to overcome the aforementioned disadvantages, which makes it possible to adapt the filling machine to different products in a simple, rapid and economical manner.

To this effect, an embodiment of the invention proposes a machine for filling containers, in particular of the gravity type, comprising at least one filling station comprising a filling spout provided with a supply opening and a discharge opening, metering means comprising a blocking system, for example of the valve type, mounted in the filling spout, able to be moved automatically between a closed position and at least one open position by an actuating system;

supply means in order to supply the filling spout with filling product, the supply means comprising a supply pipe able to be supplied with filling product, connected to the supply opening of the filling spout upstream of the blocking system in relation to the direction of flow of the filling product, characterized in that the supply pipe comprises at least one section made of a flexible tube, the supply means further comprising clamping means able to clamp the flexible tube in order to modify the cross-section of the internal passage of the flexible tube, the clamping means can be moved between at least two positions corresponding to different cross-sections of the internal passage of the flexible tube.

According to embodiments, the supply pipe of the filling spout comprises a flexible tube and clamping means which make it possible to vary the cross-section of the internal passage of the flexible tube, and therefore to vary the loss of head according to the viscosity of the filling product and/or the presence or not of pieces or of particles in the filling product, in order to control the speed of the flow of the product at the output of the filling spout and to obtain a clean metering and without overflow in an allotted timeframe.

The filling machine according to embodiments of the invention can therefore be adapted to different products, having different viscosities, in a simple, rapid and economical manner, without replacing or adding parts, in particular without replacing the supply pipe and without replacing or modifying the filling spout and/or its associated blocking system. The limitation of manual operation for the adaptation of the machine to a type of product also improves hygiene.

The clamping means can have only two positions, or several positions, in order to be able to process a multitude of filling products having different viscosities.

The flexible tube with a closed cross-section according to embodiments of the invention associated with clamping means constitute a solution that is simple to implement and effective for varying the cross-section of the supply pipe. The flexible tube can be easily inserted on a supply pipe, while still guaranteeing a substantially continuous internal passage which can be cleaned easily and in an effective manner.

According to a particularity, the clamping means can be moved between an idle position corresponding to an unclamped state of the flexible tube, wherein the flexible tube has a maximum cross-section of internal passage, and at least one active position corresponding to a clamped state of the flexible tube wherein the flexible tube has a reduced cross-section. The machine can have a single active position or a multitude of active positions. The possibility of easily and quickly returned to a maximal cross-section also allows for better cleaning of the machine. The cleaning of the machine can advantageously be carried out in the unclamped state of the flexible tube.

According to an embodiment, the filling spout comprises a globally tubular body, the supply opening being more preferably formed radially on the tubular wall of the body, the blocking system comprising a valve which is mounted in the tubular body and controlled in opening and in closing by an actuating system comprising a cylinder, the cylinder body being arranged above the filling spout and its rod extending substantially axially in the tubular body and carrying at the end the valve. Alternatively, the supply opening is formed by the open upper axial end of the tubular body. The valve is then more preferably controlled by an actuating system of the magnetic type.

According to an embodiment, the clamping means comprise a first fixed bar and a second mobile bar between which is arranged the flexible tube, the first fixed bar being preferably substantially in contact with the flexible tube, and the second mobile bar being able to be displaced between an idle position and an active position by an actuating device.

According to an embodiment, the flexible tube is arranged in such a way that its longitudinal axis forms a non-zero angle and less than 90° in relation to the horizontal, the first fixed bar being arranged under the flexible tube. These clamping means wherein only the bar arranged above is mobile make it possible to elastically deform the flexible tube only via the top and as such prevent zones retaining the filling product in the flexible tube.

According to another embodiment, the flexible tube is arranged substantially vertically, said clamping means comprise a first bar and a second bar between which is arranged the flexible tube, the first bar and/or the second bar being able to be displaced between an idle position and an active position by an actuating device.

According to embodiments of the invention, clamping means of a simple design can be used to act simultaneously on several flexible tubes of different filling stations. According to an embodiment, the filling machine comprises several filling stations, the clamping means comprising at least one clamping system able to simultaneously clamp the flexible tubes of several filling stations, the clamping system comprising a first bar and a second bar between which pass flexible tubes, and an actuating device in order to displace at least one of the two bars between an idle position and at least one active clamping position.

According to another embodiment, the filling machine comprises several filling stations with a clamping system and its associated actuating device for each filling station.

According to an embodiment, the machine comprises several filling stations and an on-board distribution tank or a feed line connected to an offset storage tank, each filling station comprising a supply pipe connecting the filling spout to the storage tank or to the feed line.

According to an embodiment, the machine is of the rotating type, the filling stations being arranged with even angular spacing on a carrousel, the supply pipes extending radially from the filling spouts towards the distribution tank or the feed line centered according to the axis of rotation of the carrousel.

According to an embodiment, the clamping systems are arranged with even angular spacing, the first bar and the second bar of each clamping system extending in an arc of a circle.

According to an embodiment, each supply pipe of a filling station comprises a first rigid tube and a second rigid tube connected respectively to the distribution tank or the feed line, and to a filling spout, the flexible tube, possibly provided with rigid tips with a flange being mounted, in a removable manner, between the free ends of the two rigid tubes, possibly provided with a flange.

BRIEF DESCRIPTION OF THE DRAWINGS

The invention shall be better understood, and other purposes, details, characteristics and advantages shall appear more clearly in the following detailed explanatory description of a currently preferred particular embodiment of the invention, in reference to the annexed diagrammatical drawings, wherein.

DETAILED DESCRIPTION

Figure 1:
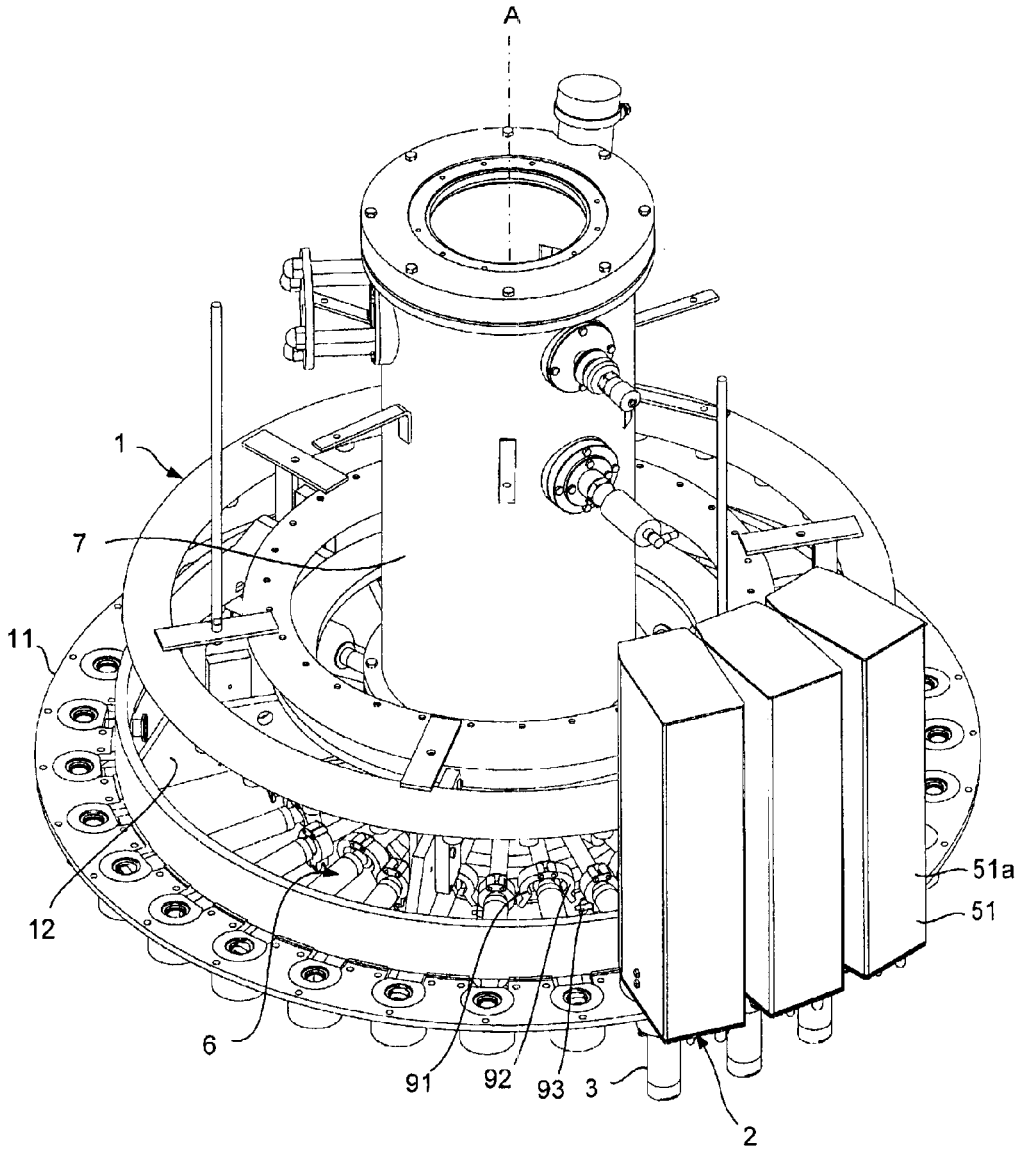
FIGS. 1 and 2 are two diagrammatical views in perspective of a filling machine according to the invention, without the clamping means, wherein only a portion of the filling stations is shown.

In this embodiment shown in the figures, the filling machine is of the rotating type, and comprises a carrousel 1 comprising a support structure 10 intended to be mounted rotatingly on a fixed frame (not shown) around a vertical axis A of rotation. The carrousel 1 carries a plurality of filling stations 2 arranged with even angular spacing around the axis A of rotation. Each filling station 2 comprises a filling spout 3 mounted vertically on a crown 11 of the structure support.

Figure 3:
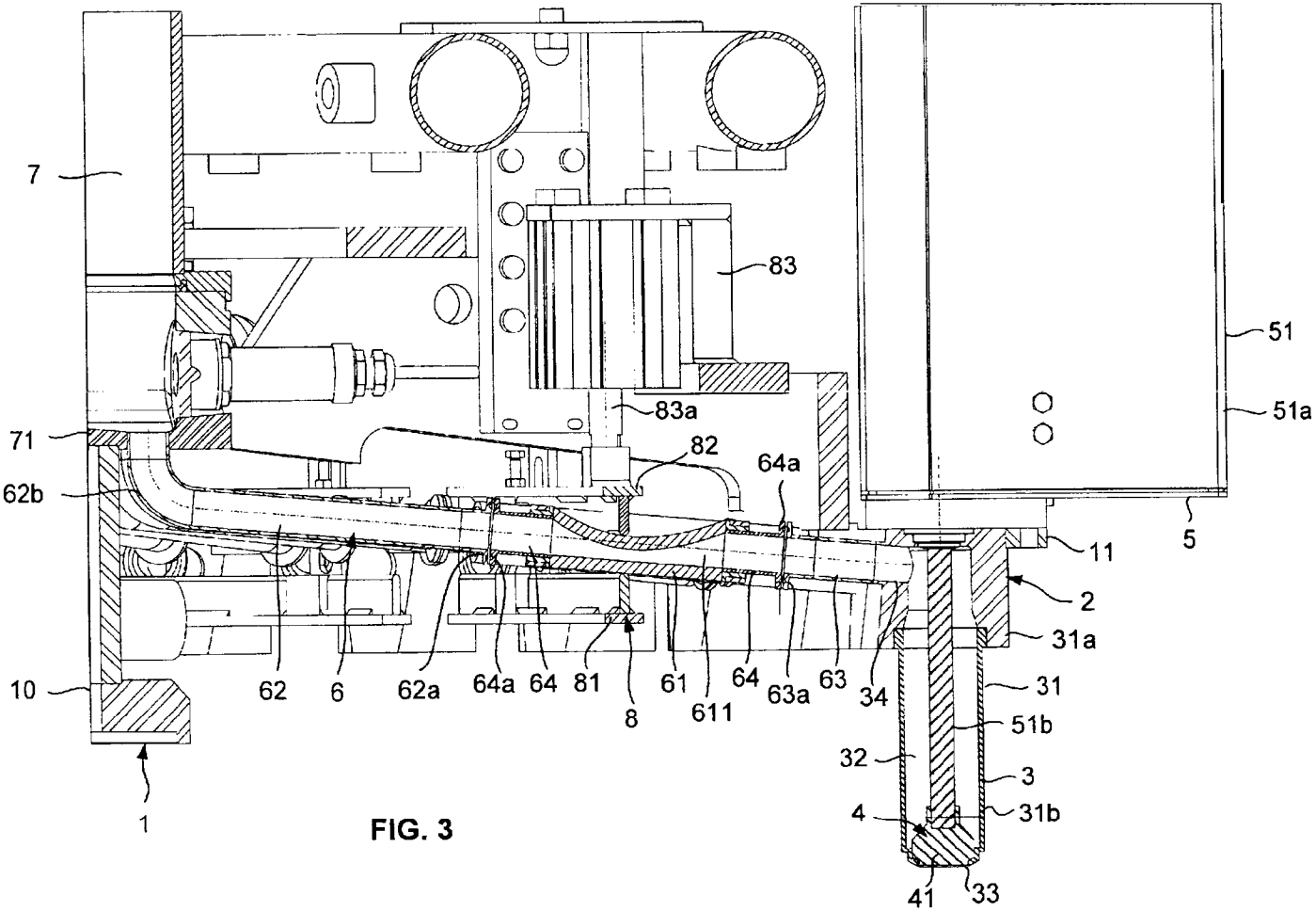
FIG. 3 is a partial transversal cross-section view of the filling machine of FIGS. 1 and 2, provided with clamping means, the section being realised on a filling station, with the clamping means in an active position; and, FIG. 4 is a diagrammatical view in perspective of the clamping means of the machine of FIGS. 1 and 2, the clamping means being in their active position.

In reference to FIG. 3, the filling spout 3 is formed of a globally tubular body 31 having an internal passage 32, an open upper axial end and a lower axial end constituting the discharge opening 33 of the filling spout. The tubular body is provided with a radial supply opening 34 for the supply of the spout with filling product. The tubular body is mounted on the lower face of the crown 11, on an opening of the latter.

Product metering means are associated with each filling spout in order to deliver a determined quantity of filling product in each container brought under the filling spout. These metering means include a blocking system 4 comprising a valve 41 arranged in the filling spout. This valve is controlled in opening and in closing by a control system 5 comprising a cylinder 51, for example pneumatic. The body 51*a* of the cylinder is mounted on the upper face of the crown 11 and its rod 51*b* extends substantially axially in the internal passage 32 of the filling spout and carries at its free end the valve 41, in such a way that the valve can be displaced in vertical translation by the cylinder between a closed position, shown in FIG. 3, in order to close the discharge opening, and open positions in order to open the discharge opening. The metering means are for example of the weighted type, the cylinder being controlled by a weight sensor placed on a container support system associated with the filling station. Alternatively, the cylinder is controlled by a sensor detecting the filling level of the container or a filling rate sensor that is inserted between the container and the spout during filling.

The tubular body 31 is advantageously constituted of two portions in order to facilitate the assembly and disassembly of the filling spout: a first portion 31*a*, provided with the upper axial end and the supply opening 34, is mounted on the lower face of the crown 11, and a second portion 31*b* provided with the discharge opening, is mounted in a removable manner on the first portion.

Each filling station further comprises supply means connected to the supply opening 34 in order to supply the filling spout with filling product. The supply means include a supply pipe 6 connected to the supply opening of the filling spout. The supply pipes of all of the filling spouts are connected on one side to a filling spout and on the other side to the same distribution tank 7 mounted on the support structure 10. In a known manner, this on-board distribution tank is supplied with filling product from an offset storage tank via a feed line, the distribution tank serving as a buffer zone. Alternatively, the distribution tank can be replaced with a feed line connected to an offset storage tank.

According to embodiments of the invention, this supply pipe 6 comprises a section constituted of a flexible tube 61, elastically deformable, also called a hose, able to be clamped by clamping means 8 mounted on the support structure 10 in order to vary the cross-section of the internal passage 611 of the flexible tube, and as such adapt the loss of head to the type of filling product.

In the embodiment shown, the supply pipe comprises three sections, an intermediary section constituted of a flexible tube, for example made of elastomer material, connected at the end to two end sections constituted of rigid tubes 62, 63. A first rigid tube 62 is connected to the distribution tank 7 and a second rigid tube 63 is connected to the supply opening 34 of the filling spout.

The flexible tube and the rigid tubes are substantially straight and have interior cross-sections that are substantially identical. The first rigid tube and the second rigid tube are mounted respectively on the tank and the filling spout in such a way that the tubes 61, 62, 63 constituting the supply pipe form a non-zero angle in relation to the horizontal, between 1° and 45°, for example of about 5°. In the embodiment shown, the first rigid tube 62 is connected by an elbow end portion 62*b* to the bottom wall 71 of the tank 7. The second rigid tube 63 is formed of a single piece with the first portion 31*a* of the filling spout.

Figure 2:
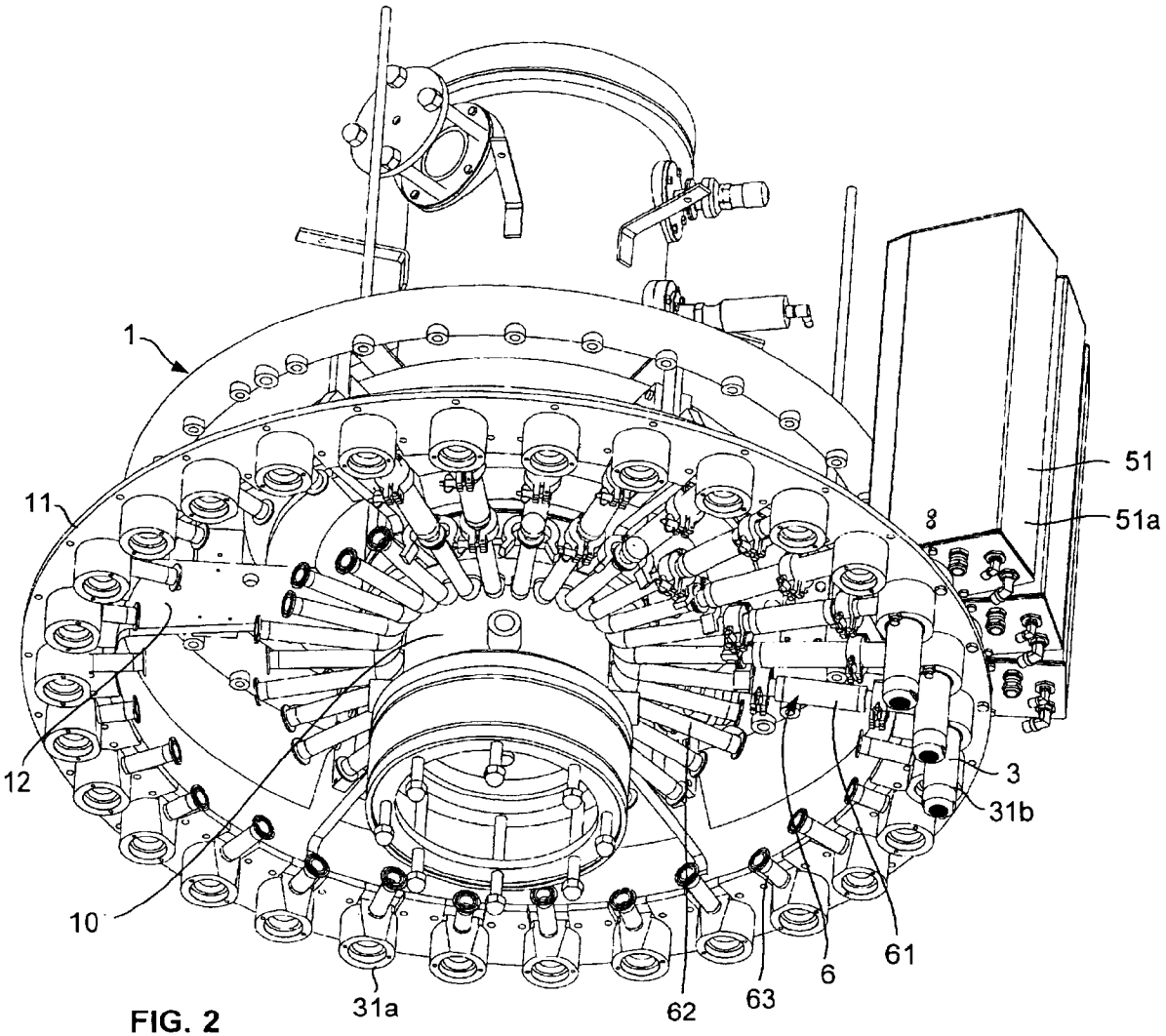

The flexible tube is mounted in a removable manner between the free ends of the two rigid tubes, in such a way as to obtain an internal passage of the supply pipe having a surface that is substantially continuous. The flexible tube is crimped or press-fitted on two rigid tips 64 of the clamp type, each provided with a flange 64*a* for their assembly to the free ends of the rigid tubes 62, 63 also provided with flanges 62*a*, 63*a*. Such as shown in FIGS. 1 and 2, the blocking of the flanges is carried out by means of two split rings 91, 92 with a U-shaped transversal cross-section, articulated to each other by a first end, and provided at their second end with a tightening system 93, the tightening system comprising for example a wing nut which is screwed on a threaded rod mounted pivotingly on a split ring and able to be latched in a slot of the other split ring. The two split rings are nested on the flanges then tightened by the tightening system in order to maintain in a sealed manner the two flanges against one another. Alternatively, the connectors of the clamp type, with tips and split rings, can be replaced with connectors of the DIN type or connectors of the SMS type.

For each filling station, the clamping means 8 comprising a first bar 81, referred to as lower, mounted fixed on the radial cross-members 12 of the support structure 10, under the flexible tube 61, in contact with the latter, and a second bar 82, referred to as upper, mounted mobile on the radial cross-members 12 of the support structure 10 above the flexible tube, the two bars being substantially aligned vertically. The upper bar can be moved vertically between an idle position and an active position by an actuating device 83 of the cylinder type. In its idle position, the upper bar 82 is separated from the flexible tube, or simply in contact with the flexible tube, the flexible tube being in an unclamped state. From this idle position, the upper bar can be displaced vertically downwards by the actuating device to its active position shown in FIG. 3, in order to clamp the flexible tube and as such reduce the cross-section of its internal passage via elastic deformation. When the upper bar is brought back to its idle position, the flexible tube elastically returns to its unclamped state.

Figure 4:
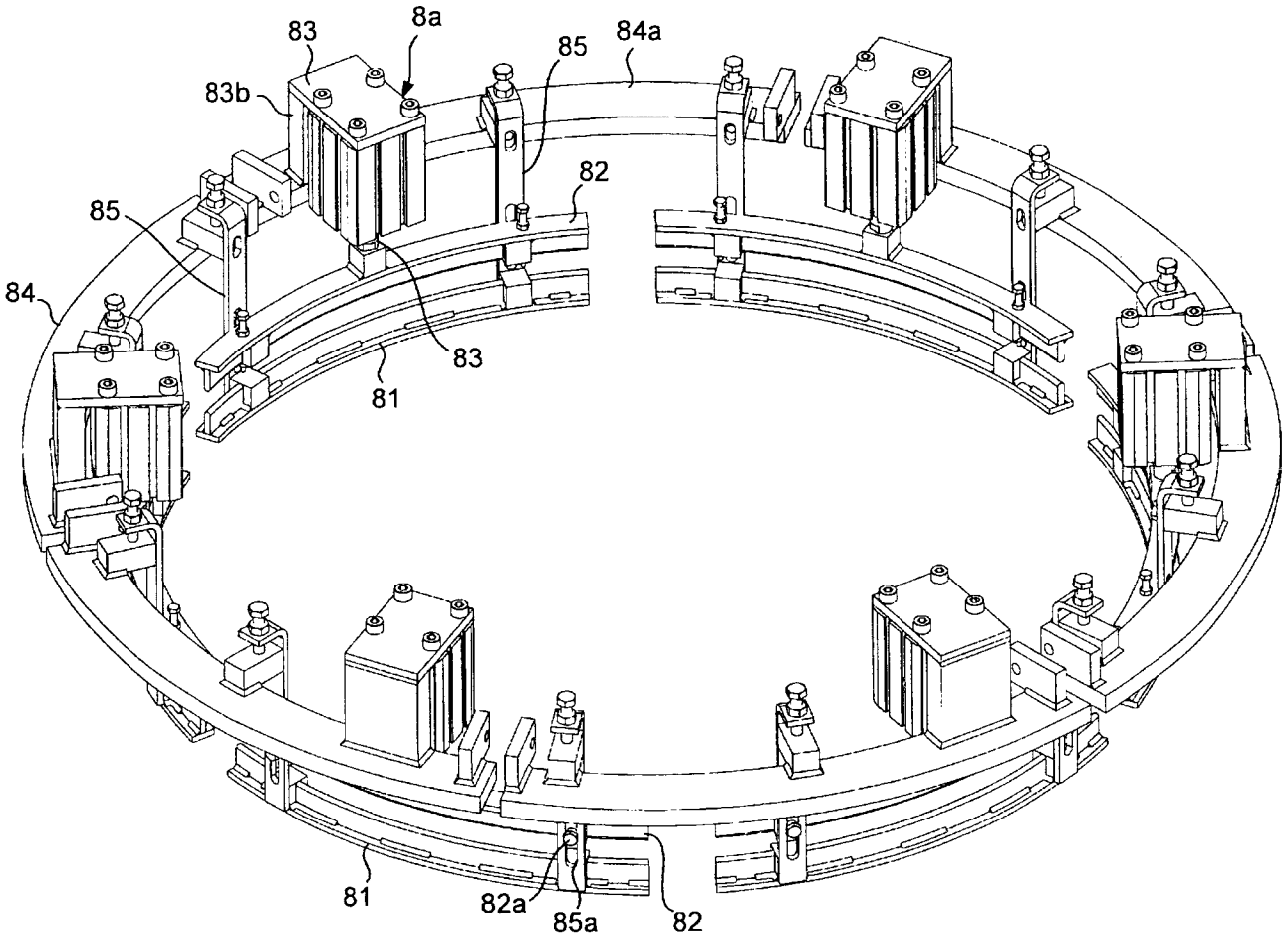

In this embodiment, the machine comprises clamping means that are common to several adjacent filling stations. In reference to FIG. 4, the machine comprises several clamping systems 8*a*, for example in the number of six, offset angularly around the axis A. Each clamping system comprises a lower bar 81 and an upper bar 82 which extends in an arc of a circle, between which pass the flexible tubes of several adjacent filling stations. Each clamping system further comprises an actuating device of the upper bar, here formed of a cylinder 83 for example of the pneumatic type.

The clamping systems 8*a* are mounted on a support ring 84 formed of several elements in an arc of a circle mounted between radial cross-members 12 (FIG. 1) of the support structure 10. The lower bar 81 of each clamping system is mounted in a fixed manner to the free ends of two vertical lugs 85 integral with the support ring 84. The upper bar is mounted at the free end of the rod 83*a* of the cylinder, the body 83*b* of the cylinder being mounted on the support ring 84, between the vertical lugs 85. In order to guide the movement in vertical translation of the upper bar 82 between its two positions, the upper bar is mounted slidingly on the two vertical lugs 85, the upper bar comprising for example two studs 82*a* mounted slidingly in openings 85*a* of the vertical lugs. In the example shown in the figures, the machine comprises thirty filling stations and six clamping devices 8*a* associated with five filling stations 2, three flexible tubes being for example arranged between two vertical lugs, and one tube beyond each vertical lug. The upper bars of the clamping systems are displaced together in idle position or in active position via the simultaneous control of their cylinder in order to adapt the machine to two different filling products.

Such as indicated previously, the loss of head of the supply pipes, and therefore the rate of the filling product in said supply pipes, and therefore the speed of the flow of the product on the discharge opening 33 of the filling spout can be adapted easily according to the filling product to be metered, automatically and simultaneously for all of the filling stations, without replacing or adding any part, which simplifies the manipulation to pass from one product to another product having a different viscosity and increases the level of hygiene by avoiding manual interventions within the metering enclosure.

Alternatively, the pneumatic cylinders 83 are replaced with electric cylinders of the "brushless" type, making it possible to adjust the upper bars to different active positions, and as such process several filling products having different viscosities on the same machine.

It is of course understood that the invention is not limited to this type of machine, the machine able to be of the linear type, with one or several metering stations, with an offset storage tank or built into said machine.

Although the invention has been described in connection to a particular embodiment it is in no way limited to this, and it comprises all of the technical equivalents of the means described as well as combinations thereof if the latter fall within the scope of the invention.

The invention claimed is:

1. A machine for filling containers, including at least one filling station, comprising a filling spout provided with a supply opening and a discharge opening;

metering means comprising a blocking system mounted in the filling spout, able to be moved between a closed position and at least one open position; and, supply means in order to supply said filling spout with filling product, said supply means comprising a supply pipe, connected to the supply opening of the filling spout upstream of said blocking system, said supply pipe comprising at least one section made of a flexible tube having an internal passage, said supply means further comprising clamping means able to clamp said flexible tube in order to modify the cross-section of the internal passage of said flexible tube, said clamping means movable between at least two positions corresponding to different cross-sections of the internal passage of the flexible tube, wherein the filling machine includes several filling stations arranged around an axis A of rotation, said clamping means comprising at least one clamping system able to clamp simultaneously the radial flexible tubes of several filling stations, said clamping means comprise a first fixed bar and a second mobile bar between which passes flexible tubes, and the second mobile bar being able to be displaced between an idle position and an active position by an actuating device, the first and the second bars extending in an arc of a circle.

2. A filling machine according to claim 1, wherein said clamping means can be moved between an idle position corresponding to an unclamped state of the flexible tube, wherein said flexible tube has a maximum cross-section of internal passage, and at least one active position corresponding to a clamped state of the flexible tube wherein the flexible tube has a reduced cross-section.

3. A filling machine according to claim 1, wherein the filling spout comprises a globally tubular body, the blocking system comprising a valve which is mounted in said tubular body and controlled in opening and in closing by an actuating system comprising a cylinder having a cylinder body and a rod, the cylinder body being arranged above the filling spout, and the rod extending substantially axially in the tubular body and carrying at the end said valve.

4. A filling machine according to claim 3, wherein the supply opening is formed radially on the tubular wall of said body.

5. A filling machine according to claim 1, wherein said flexible tube is arranged in such a way that its longitudinal axis forms a non-zero angle less than 90° in relation to the horizontal, the first fixed bar being arranged under said flexible tube.

6. A filling machine according to claim 1, comprising several filling stations and an on-board distribution tank or a feed line connected to an offset storage tank, each filling station comprising a supply pipe connecting the filling spout to said storage tank or to said feed line.

7. A filling machine according to claim 6, the filling machine being of the rotating type, said filling stations being arranged with even angular spacing on a carrousel, the supply pipes extending radially from the filling spouts to the distribution tank or the feed line centred according to the axis (A) of rotation of the carrousel.

8. A filling machine according to claim 7, wherein the clamping systems are arranged with even angular spacing.

9. A filling machine according to claim 7, wherein each supply pipe of a filling station comprises a first rigid tube and a second rigid tube connected respectively to the distribution tank or to the feed line, and to a filling spout, said flexible tube being mounted between the free ends of the two rigid tubes.

* * * * *